US009273889B2

(12) United States Patent
Bernardi et al.

(10) Patent No.: US 9,273,889 B2
(45) Date of Patent: Mar. 1, 2016

(54) MONITORING AND CONTROL SYSTEM FOR A HEAT PUMP

(75) Inventors: William P. Bernardi, Ligonier Township, PA (US); Jeffrey J. Calabro, Michigan City, IN (US)

(73) Assignee: United States ThermoAmp Inc., Latrobe, PA (US)

( * ) Notice: Subject to any disclaimer, the term of this patent is extended or adjusted under 35 U.S.C. 154(b) by 744 days.

(21) Appl. No.: 13/453,438

(22) Filed: Apr. 23, 2012

(65) Prior Publication Data

US 2012/0266620 A1 Oct. 25, 2012

Related U.S. Application Data

(60) Provisional application No. 61/477,873, filed on Apr. 21, 2011.

(51) Int. Cl.
*F25B 49/02* (2006.01)
*F25B 49/00* (2006.01)

(52) U.S. Cl.
CPC ..... *F25B 49/005* (2013.01)

(58) Field of Classification Search
CPC ..... G01K 7/42; G01K 2007/422; G01K 1/20; F25B 2700/2106; F24F 2011/0013
See application file for complete search history.

(56) References Cited

U.S. PATENT DOCUMENTS

| | | | | |
|---|---|---|---|---|
| 5,507,154 | A * | 4/1996 | Grant | 62/156 |
| 6,123,146 | A * | 9/2000 | Dias | 165/202 |
| 6,138,919 | A * | 10/2000 | Cooper et al. | 237/2 B |
| 6,378,320 | B1 * | 4/2002 | Matambo et al. | 62/259.2 |
| 6,974,251 | B2 * | 12/2005 | DeRonne et al. | 374/144 |
| 7,364,353 | B2 * | 4/2008 | Kolk | 374/1 |
| 7,784,705 | B2 * | 8/2010 | Kasper et al. | 236/44 C |
| 8,954,288 | B2 * | 2/2015 | Aljabari | 702/130 |
| 2006/0168973 | A1 * | 8/2006 | Lewis | 62/175 |

* cited by examiner

*Primary Examiner* — Marc Norman
(74) *Attorney, Agent, or Firm* — The Webb Law Firm

(57) ABSTRACT

Disclosed is a monitoring and control system for an air source heat pump apparatus having a controller to control at least one operation of the heat pump apparatus, a temperature sensor to detect the temperature in a specified area at, near, and/or around the controller, and an operable component, the system including a control program to: determine the temperature based on the detected temperature of the temperature sensor; determine whether a first condition exists, the first condition including a determination that the controller is powered, but the operable component is not operating; determine whether a second condition exists, the second condition including a determination that the controller is powered, and the operable component is operating; and based at least partially on determinations (a)-(c), determine the ambient temperature at or around the heat pump apparatus.

12 Claims, 9 Drawing Sheets

MONITORING AND CONTROL SYSTEM FOR A HEAT PUMP

BACKGROUND OF THE INVENTION

1. Field of the Invention

The present invention relates generally to heat pumps and devices and systems that effect the temperature of the surrounding area or a chosen medium, and in particular to a monitoring and control system and method for a heat pump, preferably an air source heat pump, such as an air source heat pump used in connection with a swimming pool, aquarium, fish pond, or other body of water or liquid.

2. Description of the Related Art

Air source heat pumps have been used in various applications to remove heat from the outdoor air and move it to another fluid or heat sink for space and water heating, as well as other applications, such as process heat for industrial and commercial applications, swimming pools, agricultural aquariums, fish ponds, and the like. Such heat pumps are increasingly being utilized in applications where a cost effective heating method is required, such as in areas where the fossil fuel cost per BTU (British Thermal Unit) delivered is greater than the cost of the electricity required to move a BTU of heat from the air using a heat pump.

However, in certain low temperature air source heat pump applications where the exhaust air temperature (i.e., the air already cooled by the heat pump's evaporator) moves below the freezing point, the moisture it contained is left behind frozen on the evaporator tube. In this manner, subsequent and severe icing can occur in the heat pump and its components, which impacts and limits the ability of the heat pump to effectively extract heat from air. When the air temperature goes below the approach of the heat pump evaporator, thus causing the moisture in the air to freeze on the evaporator tubes, the frost effectively insulates the refrigerant inside from further heat transfer.

In a space heating application, where heat must be delivered to the living space in a structure, a second more-costly heat source is often required, such as fossil fuel or resistance electric heat, in order to provide space heating below the heat pump icing temperature. Where the same space heating heat pump is designed using a reversing valve to also provide air conditioning or cooling in warm temperatures, it is capable (in winter heating mode) of defrosting the evaporator or outside coil by operating temporarily in the reversed mode, and removing heat from the heated space to melt the ice on the outside coil. While this is more efficient than using more costly backup heat, at some lower air temperatures or certain applications, the cost advantage is lost, and backup heat must be used for economical reasons.

In the case of air-to-water heat pumps, such as swimming pool heaters, where this limitation is less critical and where frosting only occurs at the low end of the "swimmable" or required range of operating air temperatures, a backup source or costly reversing valve can be avoided if the heat pump's frost-free low air temperature operation is maximized. The actual air temperature at which icing occurs in any outdoor evaporator coil is a function of the tube surface temperature, the amount of moisture in the air, and the air velocity. Although any moisture present will condense below the dew point, and deposit ice or frost as the tube surface temperature is below freezing, the amount of moisture in the air determines how much frost or ice will accumulate and how fast.

In such applications, there exists a cut-off air temperature, below which icing is certain at almost any humidity, and slightly above that is an air temperature at which negligible frost will occur regardless of the humidity. The tube surface temperature will reach freezing at a range of internal refrigerant evaporating temperatures, depending on the mass flow rate of the refrigerant, as well as the size and design of the heat exchanger and the air velocity. To avoid ice formation by shutting off the heat pump as it reaches the freeze point, existing heat pumps either directly measure the tube surface temperature or the air temperature, and shut off the heat pump at an appropriate temperature above the frosting point.

While measuring the tube surface temperature appears to an effective straightforward method, it requires a sensor on the tube, which, in turn, requires wiring and electronic circuitry (or a thermostatic bulb type sensor and capillary controller), all of which significantly increase the cost of the heat pump controls and reduce it's reliability, since the additional sensor and wires (or capillary and bulb) are subject to damage from weather, rodent, insect, or human tampering. In addition, when ice does form on or around the sensor, it will affect the sensors accuracy until the ice melts, which can delay restarting the heat pump when the air temperature has risen well above the frost point, thus defeating the intended purpose of maximizing low temperature operation.

An alternate method to address this frosting issue is to indirectly monitor the refrigeration system pressure (using a pressure switch) to determine the refrigerant evaporating temperature inside the tube. The switch is set to cut-out at a pressure corresponding to a tube surface temperature that is at the freezing point.

Using a pressure switch is a less costly alternative, as most heat pumps already use one to detect loss of refrigerant, and this switch could be set to a cut-out pressure corresponding to an evaporating temperature, which produces a tube surface temperature just above freezing. Once the switch shuts the heat pump off, the suction or evaporating pressure and the condensing or discharge pressure will equalize, since the compressor has stopped pumping gas. This stabilization pressure is equal to the saturation pressure of the refrigerant gas/liquid mixture at the ambient air temperature, which will be higher than the suction pressure. Thus, the cut-out pressure of the switch must be set at the suction pressure corresponding to freezing tube surface temperatures when the heat pump is running, while the reset or cut-in pressure of the switch must be slightly above the off-cycle stabilization pressure of the heat pump when it is off and equalized, otherwise the heat pump will constantly cycle off and on.

The accuracy of the pressure switch method, and using the refrigerant pressure to determine the frost cut-out temperature, is directly dependent on assumptions regarding the calculation of the tube surface temperature, and how much the pressure measured directly reflects that value. This approach is also subject to variations due to refrigerant over- or undercharge, as well as equipment performance variations, including the tolerances on the switch cut-out pressure and cut-in pressure.

Further, currently available low-cost pressure switches depend on an internally-mounted, snap-action, dome-shaped metal disc that collapses or pops out to trigger the on and off set points. Such a design is inherently inexpensive, but also has a fairly wide built-in hysteresis, which is the difference between cut-in and cut-out pressure. This design also has a widely variable pressure trip point tolerance. These factors limit the pressure switch's ability to have a cut-out pressure close to its cut-in or reset pressure, such that once the switch turns off the heat pump, it cannot reset until a much higher suction pressure and air temperature than necessary is reached, thereby losing additional low air temperature runtime. The cut-out pressure is also a function of the air flow and the overall system design, such that a different cut-out pressure is required for each model or different size heat pump, which complicates manufacturing and design, moreover increasing the cost.

Existing Industry experience using the pressure switch method has been problematic, especially with the added variability introduced by the mandated use of a specified refrigerant blend (R410A), and its glide characteristics, which cause the saturation pressure for a given refrigerant or air temperature to be variable and unpredictable. In the past, refrigerant R22 was used and had a very predictable saturation temperature for a given refrigerant or suction pressure.

As an alternative to using a fixed pressure set point switch for each model variation, measuring the actual refrigerant pressure may eliminate the use of multiple switches with different set points, since a commonly used microcomputer controller could be programmed to use the appropriate pressure for each heat pump model and design variation. However, such an approach requires a pressure transducer and attendant electronics and wiring, which is also subject to the same damage as the temperature sensor method previously discussed. In addition, the cost of a pressure transducer is relatively high, which is why current heat pumps have not adopted their use.

SUMMARY OF THE INVENTION

Therefore, and generally, provided is a monitoring and control system for a heat pump and an improved heat pump that address or overcome some or all of the deficiencies and drawbacks associated with existing heat pump applications and arrangements. Preferably, provided is a monitoring and control system for a heat pump and an improved heat pump that facilitate the determination of the onset of certain conditions, e.g., frost conditions, that may affect the operation of the heat pump. Preferably, provided a monitoring and control system for a heat pump and an improved heat pump that are cost effective when considering currently-available methods and approaches for addressing the issue of ambient temperature impact on the operation of a heat pump. Preferably, provided is a monitoring and control system for a heat pump that can utilize or be integrated with the components of an existing heat pump.

Accordingly, and in one preferred and non-limiting embodiment, provided is a monitoring and control system for an air source heat pump apparatus having at least one controller configured to control at least one operation of the heat pump apparatus, at least one temperature sensor configured to detect the temperature in a specified area at or near the controller, and at least one operable component. The system includes at least one control program stored on a computer readable medium, which, when executed by at least one processor, causes the processor to: (a) determine the temperature at or near the controller based at least in part on the detected temperature of the at least one temperature sensor; (b) determine whether a first condition exists, the first condition comprising a determination that the controller is powered, but the at least one operable component is not operating; (c) determine whether a second condition exists, the second condition comprising a determination that the controller is powered, and the at least one operable component is operating; and (d) based at least partially on determinations (a)-(c), determine the ambient temperature at or around the heat pump apparatus.

In another preferred and non-limiting embodiment, provided is a heat pump apparatus, including: at least one fan configured to draw ambient air into at least one evaporator arrangement configured to at least partially evaporate at least one liquid refrigerant into gas refrigerant; at least one compressor configured to draw the gas refrigerant from the evaporator arrangement and compress the gas refrigerant; a heat exchanger arrangement configured to elevate the temperature of a target liquid or gas; at least one controller configured to control at least one operation of the heat pump apparatus; at least one temperature sensor configured to detect the temperature in a specified area at or near the controller; and at least one control program stored on a computer readable medium, which, when executed by at least one processor of the at least one controller, causes the processor to: (a) determine the temperature at or near the controller based at least in part on the detected temperature of the at least one temperature sensor; (b) determine whether a first condition exists, the first condition comprising a determination that the controller is powered, but the at least one operable component is not operating; (c) determine whether a second condition exists, the second condition comprising a determination that the controller is powered, and the at least one operable component is operating; and (d) based at least partially on determinations (a)-(c), determine the ambient temperature at or around the heat pump apparatus.

In a still further preferred and non-limiting embodiment, and in a heat pump apparatus having: at least one fan configured to draw ambient air into at least one evaporator arrangement configured to at least partially evaporate at least one liquid refrigerant into gas refrigerant; at least one compressor configured to draw the gas refrigerant from the evaporator arrangement and compress the gas refrigerant; a heat exchanger arrangement configured to elevate the temperature of a target liquid or gas; at least one controller configured to control at least one operation of the heat pump apparatus; and at least one temperature sensor configured to detect the temperature in a specified area at or near the controller, provided is a monitoring and control system including at least one control program stored on a computer readable medium, which, when executed by at least one processor of the at least one controller, causes the processor to: (a) determine the temperature at or near the controller based at least in part on the detected temperature of the at least one temperature sensor; (b) determine whether a first condition exists, the first condition comprising a determination that the controller is powered, but the at least one operable component is not operating; and (c) determine whether a second condition exists, the second condition comprising a determination that the controller is powered, and the at least one operable component is operating; and (d) based at least partially on determinations (a)-(c), determine the ambient temperature at or around the heat pump apparatus.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENTS

Figure 1:
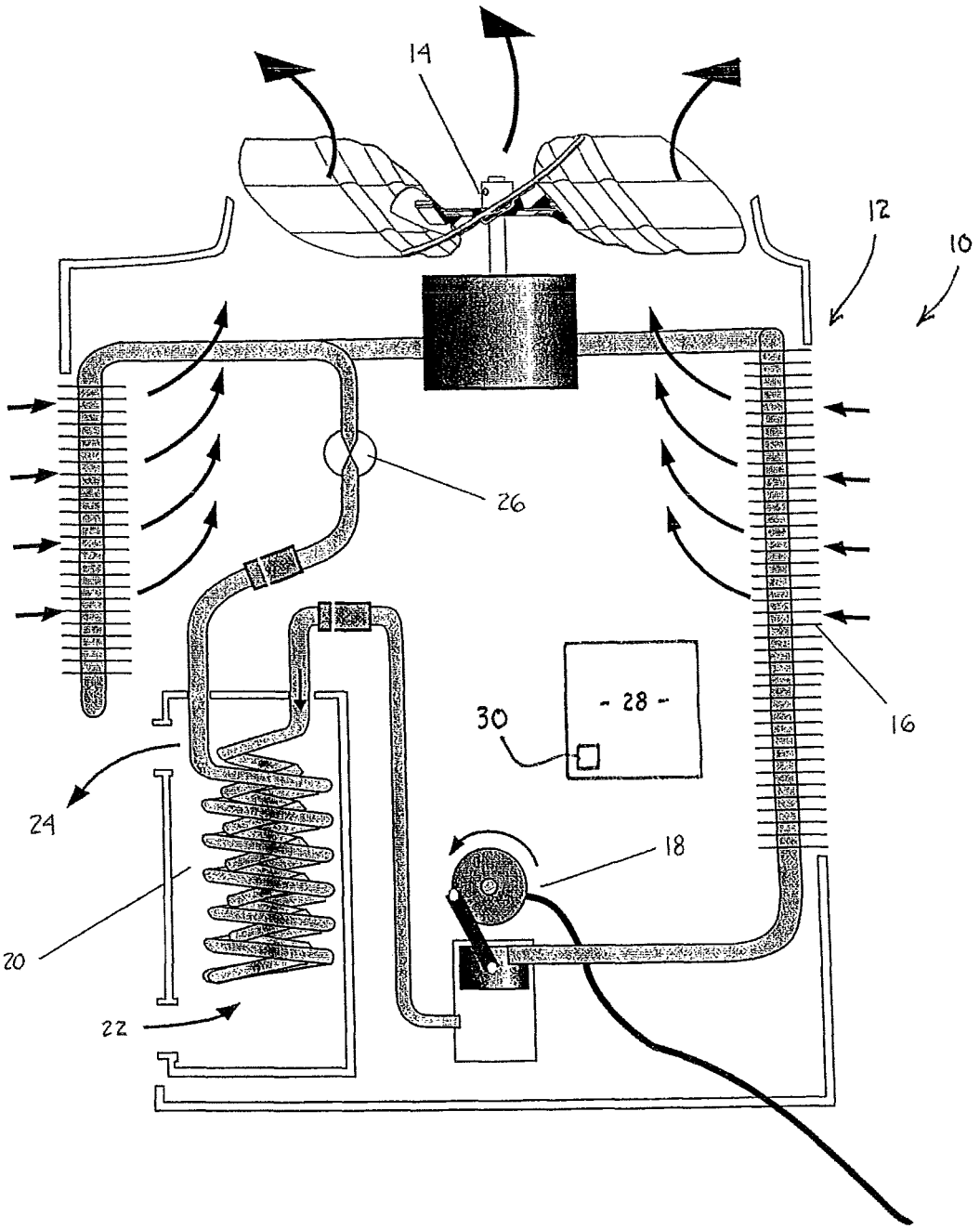
FIG. 1 is schematic view of one embodiment of an air source heat pump apparatus according to the principles of the present invention.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

The present invention is directed to a monitoring and control system 10 and heat pump apparatus 12 for use in a variety of environments and applications. In particular, the monitoring and control system 10 and heat pump apparatus 12, as illustrated in various preferred and non-limiting embodiments in FIGS. 1-8, are used in systems and arrangements that affect the temperature of the surrounding area or a chosen medium. In one preferred and non-limiting embodiment, the monitoring and control system 10 and heat pump apparatus 12 are used in connection with or are directed to an air source heat pump, such as an air source heat pump used with heating and/or cooling a swimming pool, aquarium, fish pond, body of water or liquid, and the like. Accordingly, the monitoring and control system 10 and heat pump apparatus 12 of the present invention can be used in any of the applications and environments discussed above, and in one preferred and non-limiting embodiment, in the air source heating application of a swimming pool heat pump and the like. In another preferred and non-limiting embodiment, the monitoring and control system 10 and heat pump apparatus 12 are used to maximize operation down to or about the freezing temperature without adopting or using the costly and more complex (and less reliable) methods and techniques discussed above.

One preferred and non-limiting embodiment of the monitoring and control system 10 and heat pump apparatus 12 of the present invention is illustrated in FIG. 1 in schematic form. It is further noted that this particular embodiment is in the form of a heat pump apparatus 12 that is an air source heat pump for swimming pool applications. In operation, a fan 14 draws outdoor air through an evaporator 16, which is typically in the form of a serpentine arrangement of copper tubes with aluminum fins attached to enhance heat transfer. Inside of the evaporator 16, a liquid refrigerant under low pressure is evaporated into a cold gas. This phase change absorbs significant amounts of heat from the air. The air cooled by the refrigerant in the evaporator 16 exits the top of the heat pump apparatus 12. A compressor 18 then draws the gas from the evaporator 16 and compresses the gas refrigerant, which elevates the refrigerant pressure and temperature. This hot gas then flows to a heat exchanger 20, which acts to transfer the heat to the pool water entering an inlet 22 contacting the coils of the exchanger 20 (and thus, heating the water), and exiting an outlet 24.

With continued reference to FIG. 1, a valve 26 (or restriction) then reduces the pressure by throttling the liquid back to the low pressure side of the heat pump apparatus 12 and back into the evaporator 16, thus completing the cycle. The heat pump apparatus 12 also includes a controller 28, such as a digital controller, which includes an interface and various input switches, such as those to detect whether a water pressure switch or low- or high-refrigerant switch is open or closed, as well as sensors, which are normally used to measure the water temperature and air temperature, and one or more analog-to-digital converters. In one preferred and non-limiting embodiment, the water temperature and/or air temperature measurement occurs through monitoring a resistance of a thermistor, which is remotely located inside a probe, which is, in turn, immersed in the fluid to be measured. These probes are normally connected to a circuit board that is housed behind a door in a sealed compartment together with other control and electronic components.

As seen in the preferred and non-limiting embodiment of FIG. 1, the heat pump apparatus 12 (and monitoring and control system 10) include a sensor 30 in the form of a temperature sensor configured to detect the temperature in a specified area at, near, and/or around the controller 28, which is normally in the form of a circuit board or the like. It is noted that this sensor 30 may be specifically used in connection with the controller 28 only in connection with the monitoring and control system 10 aspects of the present invention. However, it is further envisioned that the monitoring and control system 10 can be retrofitted and used in connection with an existing heat pump apparatus, as such existing heat pumps include a controller (e.g., a circuit board) that normally includes an existing temperature sensor to measure the temperature of the circuit board over time to confirm the operation and performance of the heat pump. Accordingly, the sensor 30 of the present invention can be specifically mounted and used with the controller 28 of the heat pump apparatus 12, or may represent an existing sensor already present on the circuit board of an existing heat pump apparatus.

In another preferred and non-limiting embodiment, the monitoring and control system 10 uses this sensor 30 to accurately detect and/or determine the ambient (outdoor) air temperature to prevent the heat pump apparatus 12 from operating below the frost temperature. In this manner, the present invention does not require a separate and/or remote external ambient air temperature sensor, or any of the other complex systems and arrangements discussed above.

In one preferred and non-limiting embodiment, the monitoring control system is implemented through use of a control program stored on a computer-readable medium, which, when executed by at least one processor (preferably of the controller 28) causes the processor to: (a) determine the temperature at or near the controller 28 (e.g., the circuit board) based at least in part upon the detected temperature of the temperature sensor 30; (b) determine whether a first condition exists, where this first condition is a determination that the controller 28 is powered, but at least one operable component of the heat pump apparatus 12 is not operating; (c) determine whether a second condition exists, where the second condition is a determination that the controller 28 is powered, and the operable component is operating; and (d) based at least partially on the determinations (a)-(c), determine the ambient temperature at or around the heat pump apparatus 12. It is noted that this operable component may be any of the functional components in the heat pump apparatus 12 that are indicative that the heat pump apparatus 12 is actively operating. Accordingly, this operable component may be the fan 14, the evaporator 16, the compressor 18, the heat exchanger 20, the valve 26, a motor associated with any operable component, and the like. Based upon the determination of the ambient temperature at or around the heat pump apparatus 12, the monitoring and control system 10, such as through the controller 28, can control one or more of the operations of the heat pump apparatus 12. For example, based upon the determined ambient air temperature, the controller 28 may cause the heat pump apparatus 12 to terminate or shut down operation.

As indicated, and in the above-described preferred and non-limiting embodiment, the determination of the ambient air temperature is based primarily on the use of a sensor 30 that senses temperature in a specified area, preferably at, near, and/or around the controller 28. Accordingly, and in the preferred and non-limiting embodiment of FIG. 2, a housing 32, such as in the form of a cabinet or the like, is configured or positioned to at least partially surround some or all of the operable components of the heat pump apparatus 12. In one embodiment, the housing 32 is manufactured from a plastic material, such that it is resistive to corrosive pool chemicals and/or high humidity.

Figure 2:
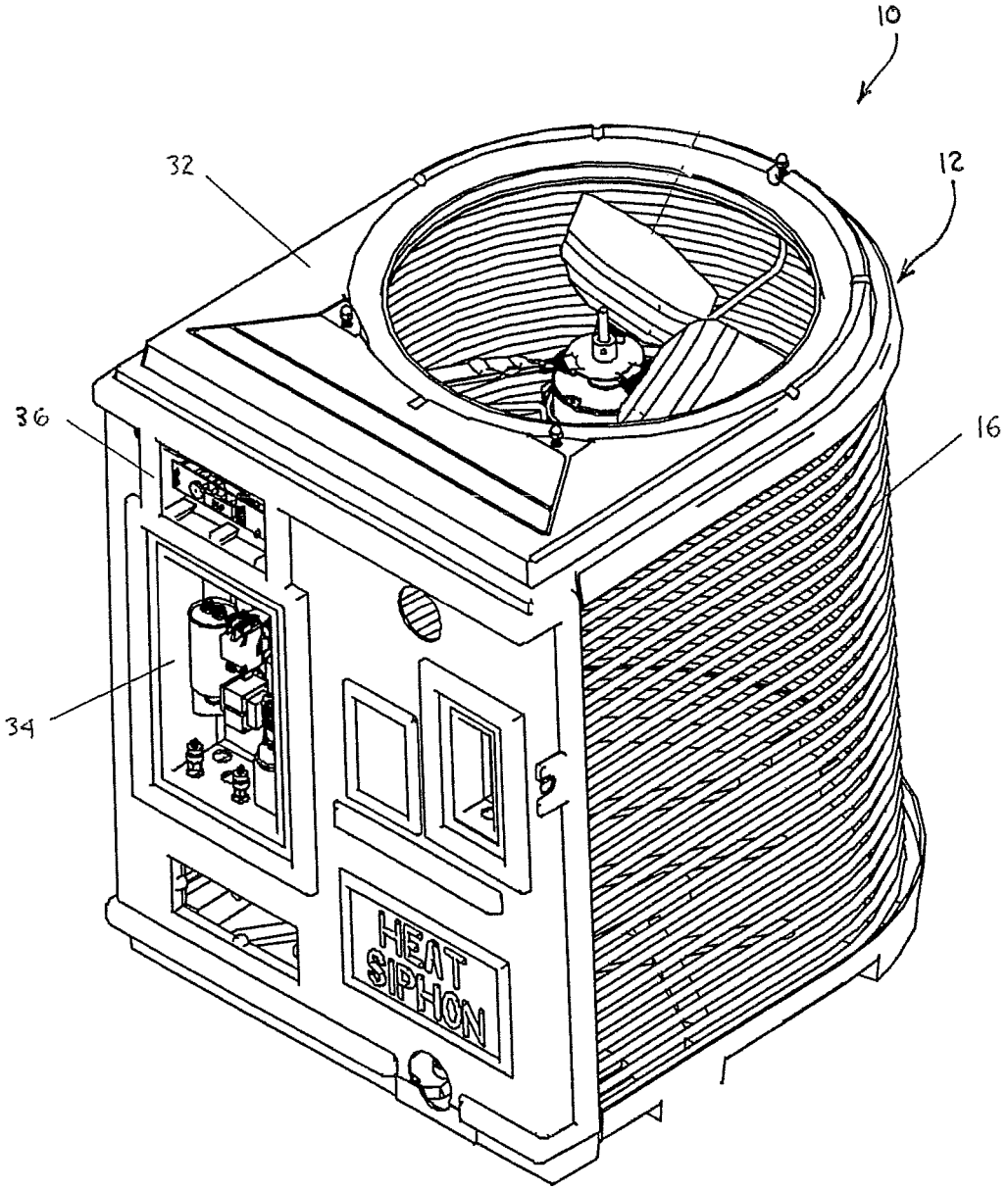
FIG. 2 is a perspective view of one embodiment of an air source heat pump apparatus according to the principles of the present invention.
Figure 3:
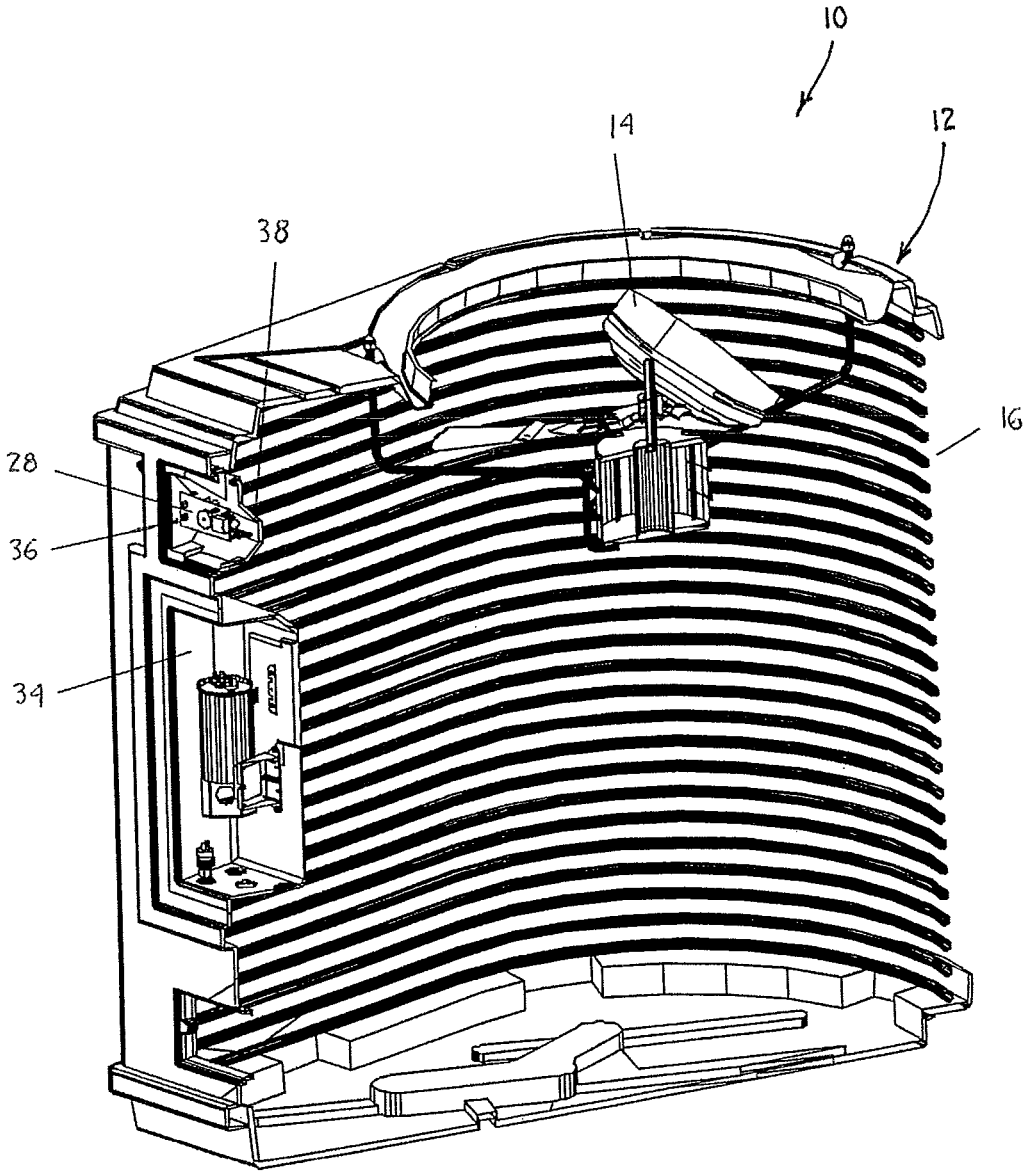
FIG. 3 is a sectional view of the air source heat pump apparatus of FIG. 2.

As further illustrated in FIGS. 2 and 3, and in another preferred and non-limiting embodiment, the heat pump apparatus 12 includes a first control pocket 34 and a second control pocket 36. The first control pocket 34 is primarily used to house the electric power switches, contactors, and high voltage capacitors required to run the fan motor and refrigerant compressor 18, which are normally positioned along with a transformer that supplies low voltage to a control circuit suitable to turn the power "on" and "off", as heating demand of the heated fluid requires. Therefore, in this embodiment, the first control pocket 34 includes the power and high voltage electrical components, including the main contactor and the supply voltage to a 24-volt alternating current transformer, which is used to supply power to the controller circuit board, as well as the contactor coil and various switches. Accordingly, the components in the first control pocket 34 generate a significant amount of heat during operation.

In order to accurately monitor the heat or temperature at, near, and/or around the controller 28, this controller 28 is positioned in the second control pocket 36, which is preferably located in a spaced relationship to the first control pocket 34. For example, the first control pocket 34 and second control pocket 36 may be located at an effective thermal distance from each other. In this manner, and by using a separate, second control pocket 36 to house the controller 28 (e.g., a digital controller circuit board), it is isolated from the heat generating effects of the power control components of the first control pocket 34. In this manner, and as discussed above, the monitoring control system 10 can use the measurement of heat gain produced by the controller 28 to determine the outside or ambient air temperature, and to check the performance and operation of the heat pump apparatus 12.

As discussed, and in one preferred and non-limiting embodiment, this second control pocket 36 contains only the controller 28 (e.g., digital controller circuit board) and no other electrical components, such as power or control transformers, which could become additional heat sources. and thus overpower the cooling effects of the airflow (which again, would negatively affect the sensitivity of the sensor 30 to changes in outside air and inside air temperatures).

In another preferred and non-limiting embodiment, and as shown in FIG. 3, the second control pocket 36 is in a substantially triangular shape, which increases the outside surface area of the shielded inside air-cooled surfaces relative to the smaller door area, while still providing a streamlined exposure to the cooling air impinging on a back surface 38 of the pocket 36, thereby maximizing convective heat transfer. In this manner, the second control pocket 36, and specifically based upon the location and positioning of the controller 28 in the control pocket 36. the controller 28 is effectively sealed from the outside air and located in the housing 32. In addition, the second control pocket 36 may be sized and shaped such that the majority of the inner surface of the control pocket 36 is facing inward and shielded from the sun (and directly in the airstream in the upper part of the air moving chamber at the exhaust end of the heat pump apparatus 12), such that air that has already passed through and been cooled by the evaporator 16 impinges upon it.

Figure 4:
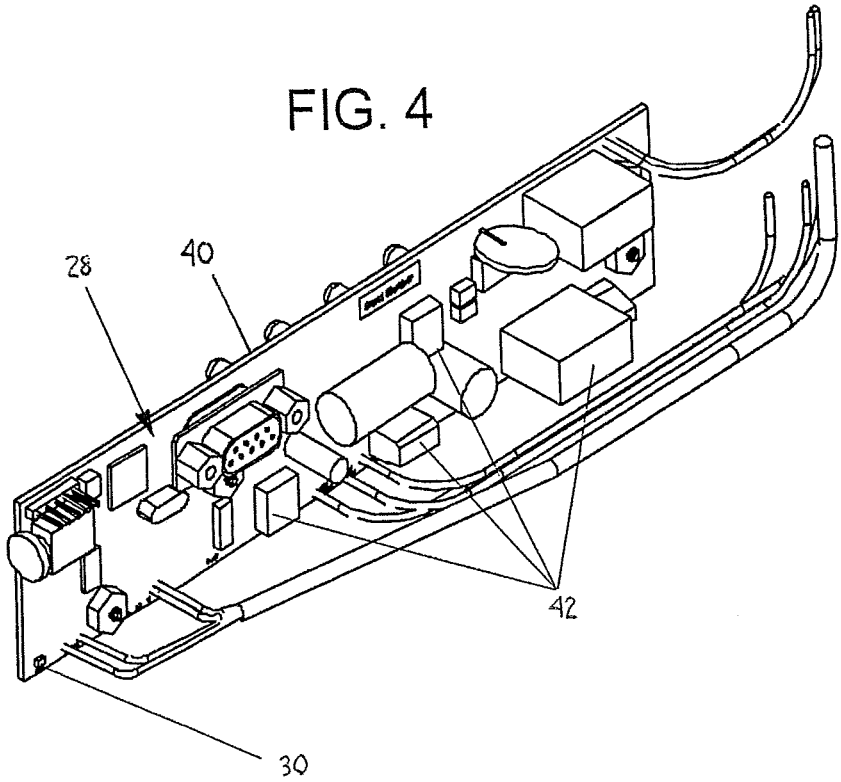
FIG. 4 is a perspective view of one embodiment of a controller for an air source heat pump apparatus according to the principles of the present invention.
Figure 5:
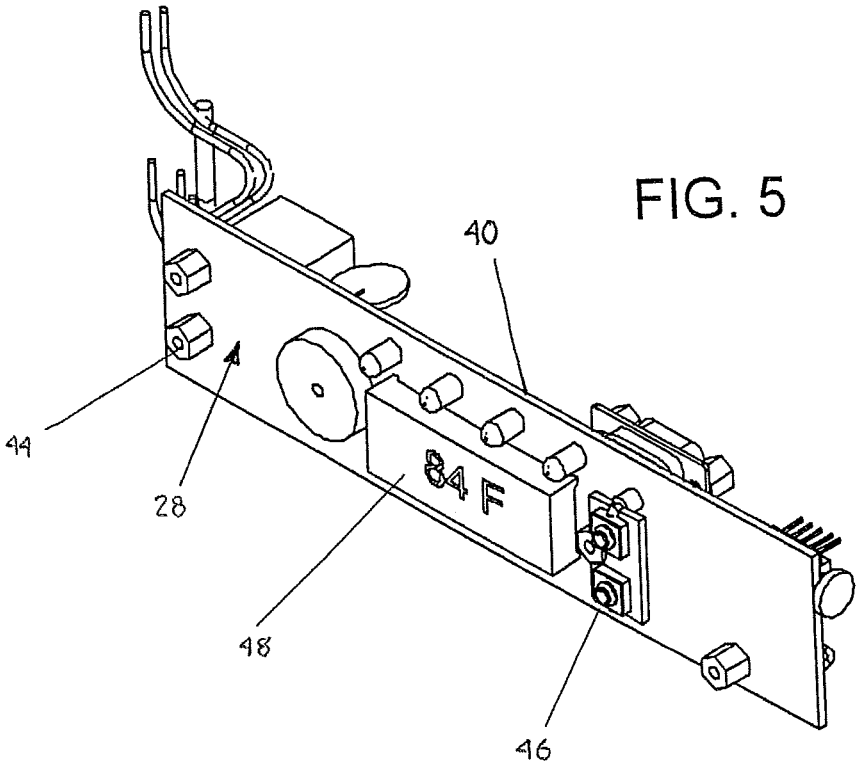
FIG. 5 is a further perspective view of the controller of FIG. 4.

A further preferred and non-limiting embodiment of the controller 28 is illustrated in FIGS. 4 and 5, where a circuit board 40 (i.e., controller 28) includes the sensor 30 located or positioned at a periphery of the circuit board 40, such as a far edge of the board 40 away from certain of the other heat-producing circuit board components 42. In this manner, the sensor 30 can more accurately detect the air temperature in the second control pocket 36 directly, which temperature would not be masked by the heat conduction of one or more of these other components 42.

With continued reference to FIGS. 4 and 5, the circuit board 40 may be mounted using stand-offs 44 to a door (not shown) to provide access to buttons 46. It is also envisioned that a window may be cut into the door, but sealed by suitable means, such as a clear decal, to prevent viewing of an LED display 48 without direct imipact of heat resulting from solar insulation on the door. In addition, the door may be colored white or have a white and/or reflective decal or covering to minimize solar gain and prevent thermal radiative heat transfer into the second control pocket 36.

As discussed above, the housing 32 may be in a variety of forms. It is envisioned that a metallic housing 32 could be used, especially in view of the beneficial characteristics discussed above in connection with the second control pocket 36. In such an arrangement, the second control pocket 36 may be formed in plastic, and could be vacuum formed as part of the housing 32. However, it is noted that the housing 32, any portion of the housing 32, and/or any of the control pockets 34, 36 are preferably formed from a plastic or other synthetic material, which provides more insulation from outdoor solar gain. This, in turn, allows the small amount of self-heating of the circuit board 40 to be more easily detected by the sensor 30, such as to enable differentiation of normal and abnormal performance, as well as provide a defined and predictable time lag to assist in calculating the exiting and ambient air temperatures.

Figure 6:
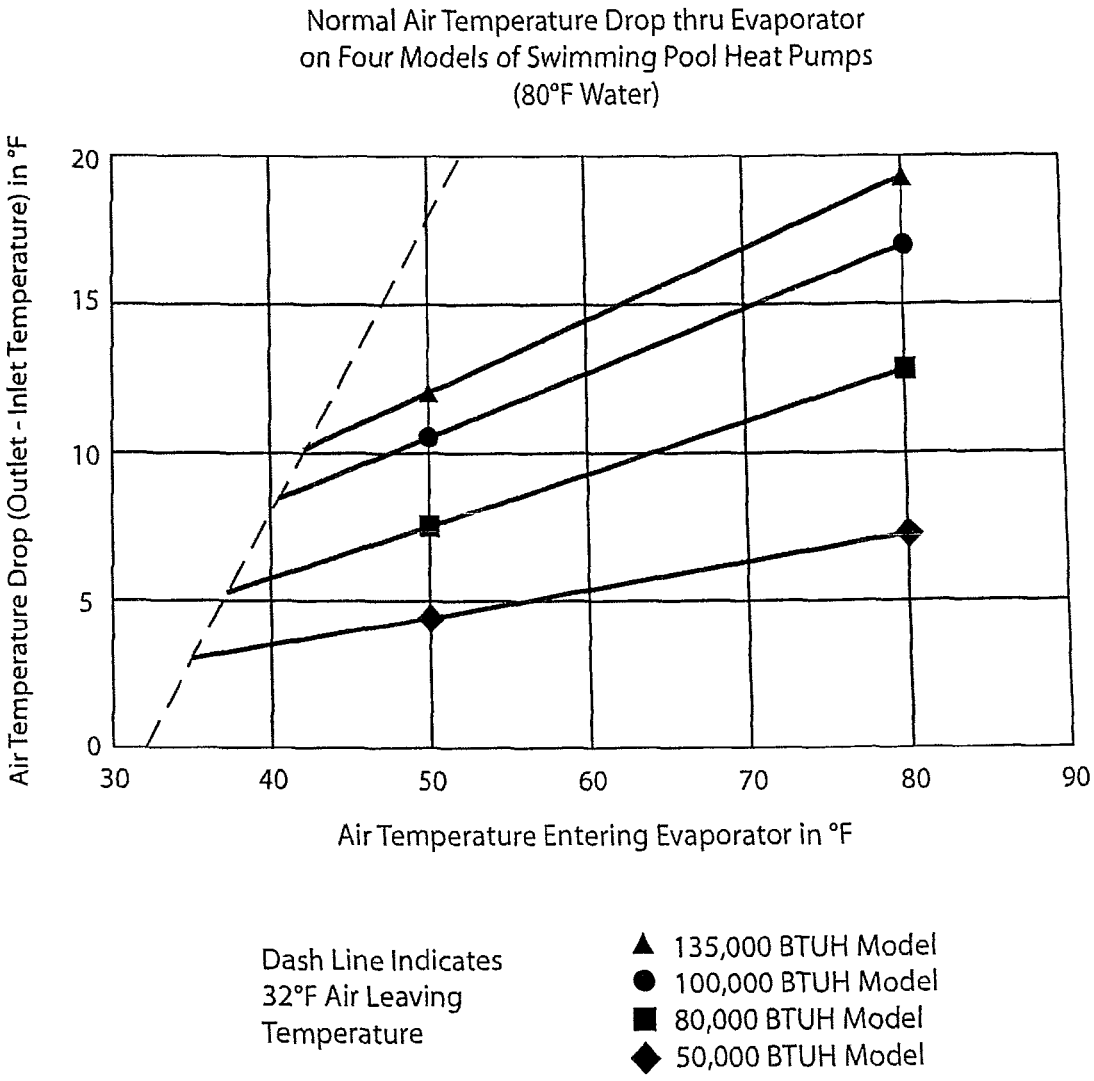
FIG. 6 is graph representing normal air temperature drop through an evaporator of an air source heat pump apparatus.

FIG. 6 is in the form of a graph of the normal air temperature drop as a function of air temperature entering the evaporator 16 for four specified models of a Heat Siphon-brand swimming pool heat pump. The inlet air temperature and corresponding outlet air temperatures were measured through testing, and it was determined that the air temperature drop for each model is approximately equal to the thermodynamic cooling required to move a given quantity of heat from the air to the pool water. The dash-line illustrates the air entering temperature, which will produce an outlet air temperature of a specified value, and which approximately defines the lower air temperature that a given model heat pump can operate before significant icing occurs.

In the case of the models indicated in FIG. 6, all airflow is substantially the same, since they all use a common fan motor and blade, and air venturi cabinet combination. Of course, it is recognized that changing any of these variables will change the air temperature drop for any given air source heat pump. However, such values can be readily measured by testing, and should behave in a substantially similar manner to that depicted in the graph in FIG. 6. In particular, a substantially linear function is expected, which slopes downward as the air entering temperature decreases. Even in those models designed to use variable speed fan motors, at any given speed, the behavior should be substantially the same, thereby providing predictable temperature drops that can be calculated using the control program and software aspects of the present invention, as discussed more fully hereinafter.

In one preferred and non-limiting embodiment, the range of interest of the air temperature is from about 35° F. to about 55° F., since this is the frost zone for most outdoor air source heat pumps. Based upon the above and the testing described in connection with the above-mentioned heat pumps, a configurable monitoring and control system 10 has been developed. It is envisioned that air source heat pumps in this field and application follow the above-described general thermodynamic characteristics, but that the monitoring and control system 10 and heat pump apparatus 12 of the present invention can be reconfigured, adapted, or programmed to be equally useful in a variety of applications without departing from the spirit, context, and scope of the present invention.

With respect to the specific temperature measurements and determinations discussed below, a Model Z575hp (Heat Siphon) swimming pool heat pump was utilized. First, when the heat pump apparatus 12 is "off" and electric power is supplied to the circuit board 40 in the second control pocket 36, it begins to heat up and stabilizes at a temperature 8° F. above the ambient air temperature after approximately 16 minutes (or about 0.5° F. per minute). Of course, it is recognized that a different controller 28 and/or circuit board 40 with differently-sized circuit components will provide a different static temperature rise and time constant to stabilization as a result of those variations. However, this rise can be measured and calculated for any variation and used in the monitoring and control system 10 of the present invention.

Second, when the heat pump apparatus 12 begins to operate, the air inside the fan compartment cools down the pocket 36 within six minutes to a temperature 3° F. below ambient temperature from the +8° F. "off cycle" stabilization temperature, for a total temperature drop of 11° F. in six minutes, or about 2° F. per minute. Third, once the stabilization temperature has reached any given state (either (1) powered controller 28 and heat pump apparatus 12 "off"; or (2) powered controller 28 and heat pump apparatus running), the ambient temperature will change so slowly relative to this heat pump event that the stabilized temperature difference for that state is maintained within 1° F.

Based upon the existence of these conditions, the monitoring and control system 10, and in particular the controller 28, may be programmed, adapted, and/or configured to determine the actual ambient outdoor air temperature at any given time. While temperature change versus elapsed time can be determined in a classic exponential heat transfer transient manner, very small differences arise between the value using a linear function to determine ambient temperature versus time. In this manner, the monitoring and control system and heat pump apparatus 12 of the present invention can use a control program in connection with the above-discussed sensor 30 in a manner which eliminates other existing temperature measurement arrangements, including their attendant external components and reduction in liability. Further, the monitoring control system 10 provides an accurate ambient air temperature that eliminates errors in time lags caused by water freezing on an external temperature sensor, which must be in contact with the tube where water is condensing and freezing to its surface.

In one preferred and non-limiting embodiment, the control program includes two primary programs (hereinafter program A and program B), in connection with the output from the sensor 30, to determine the ambient air temperature. These two temperature functions, namely program A and program B are based upon values that are determined or approximated based upon the above-discussed test results. Again, these programs can be configured, adapted, or modified to be used in connection with any heat pump apparatus with minimal and specified testing.

In general, program A is used when calculating the ambient air temperature when the heat pump apparatus 12 is idle (but powered) and program B is used when the heat pump apparatus 12 is running and cooling the air. Accordingly and generally, the ambient air temperature is based upon the existence of one of these two conditions. Based upon the determination of the first condition (i.e., the controller 28 is powered, but heat pump apparatus 12 is not operating), program A includes subtracting a specified temperature unit over a time increment from the temperature at or near the controller 28 until a stabilization temperature is reached; and thereafter, a constant temperature unit is subtracted from subsequent temperature readings at or near the controller 28 to determine the ambient temperature. Based upon a determination of the second condition (i.e., the controller 28 is powered and the heat pump apparatus 12 is actively operating), program B adds a specified temperature unit over time to the temperature at or near the controller 28 until a stabilization temperature is reached. Thereafter, a constant temperature unit is added to subsequent temperature readings at or near the controller 28 to determine the ambient temperature. Accordingly, the use of program A and/or program B is based primarily upon the identification of these conditions.

In one preferred and non-limiting embodiment of the monitoring and control system 10 of the present invention, and based upon the specified parameters for a specified heat pump apparatus, is as follows: (program A) specified temperature unit is about 0.5° F., the constant temperature unit is about 8° F., and the time increment is about one minute; and (program B) the specified temperature unit is about 2° F., the constant temperature unit is about 3° F., and the time increment is about one minute. Again, these values can be determined based upon the operating condition of the heat pump apparatus 12, and are easily obtainable through known testing procedures. Of course, it is envisioned that the control program of the monitoring and control system 10 of the present invention is fully configurable, and may be modified through a user interface or the like in order to change the appropriate variables to maximize the operating parameters of any specified heat pump apparatus 12.

In one preferred and non-limiting embodiment, program A is used while the heat pump apparatus 12 is "off", but power is applied to the circuit board 40, thereby causing heat dissipation inside the second control pocket 36, which raises the surface-mounted sensor 30 temperature until it stabilizes, and is at a fixed temperature difference above the ambient temperature. In this embodiment, program A subtracts 0.5° F. per minute, and continues this subtraction as a function of time from the temperature read by the sensor 30, until one of the following occurs: 1) the stabilization temperature is reached, where program A subtracts a constant temperature unit of 8° F. from all subsequent temperature readings of the sensor 30; or 2) the heat pump apparatus 12 starts to run or operate, at which time the control program switches to program B. At this point, the currently-calculated ambient temperature is recorded, and according to program B, the specified temperature unit of 2° F. per minute is added to the temperature reading of the sensor 30 until the on-cycle stabilization temperature difference is reached, at which point the constant temperature unit of 3° F. per minute is added to the temperature reading of the sensor 30.

At any point during execution of program B, if the heat pump apparatus 12 shuts off, then the control program immediately reverts back to program A. Accordingly, the monitoring and control system 10 of the present invention provides the effective and accurate ability to determine the ambient air temperature based upon the temperature readings of the sensor 30 and the known operating conditions of any specified component of the heat pump apparatus 12. Again, since frosting of the evaporator 16 will occur when the tube surface is at or below the freezing point of water, and given certain variables and operating parameters of a specified model of heat pump apparatus 12, the above control program (i.e., programs A and B) can be used to determine the entering air temperature at which this frosting condition is reached for a given size heat pump compressor and fan motor blade configuration. As discussed above, FIG. 6 provides such values for four basic models of the Heat Siphon-brand swimming pool heat pumps, along with the amount of air temperature drop each model produces as a function of ambient air temperature at an estimated 80° F. water temperature. It is further noted that the control program can use this determined ambient air temperature to calculate the proper cut-off air temperature for each specified model, and shut off the heat pump apparatus 12 just prior to when frosting would begin. Still further, this determination may occur on an incremental basis, a static basis, a specified basis, continually, dynamically, or the like.

Figure 7A:
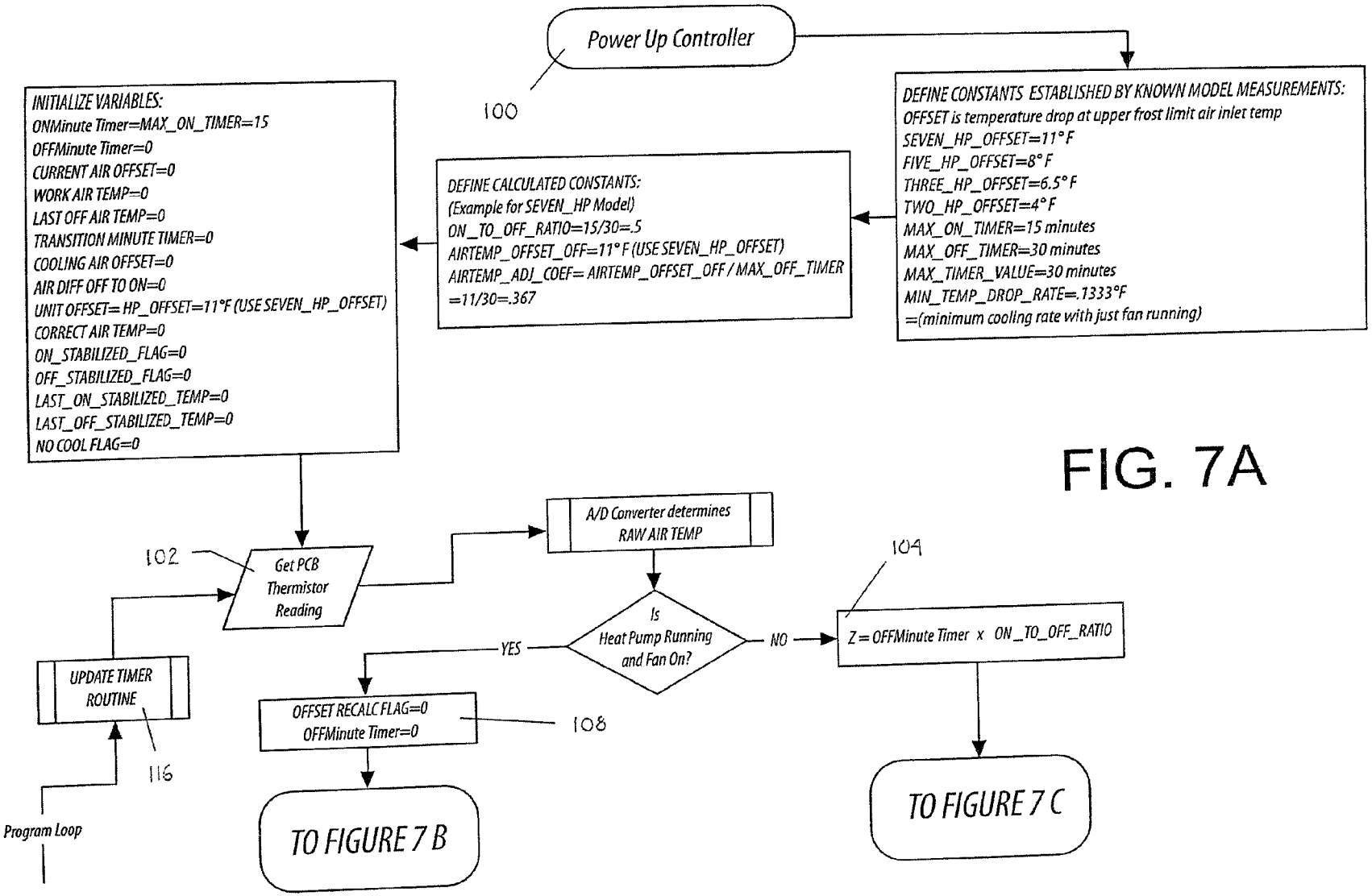
FIGS. 7A-C are flowcharts of one embodiment of a control program for a monitoring and control system for an air source heat pump apparatus according to the principles of the present invention.
Figure 7B:
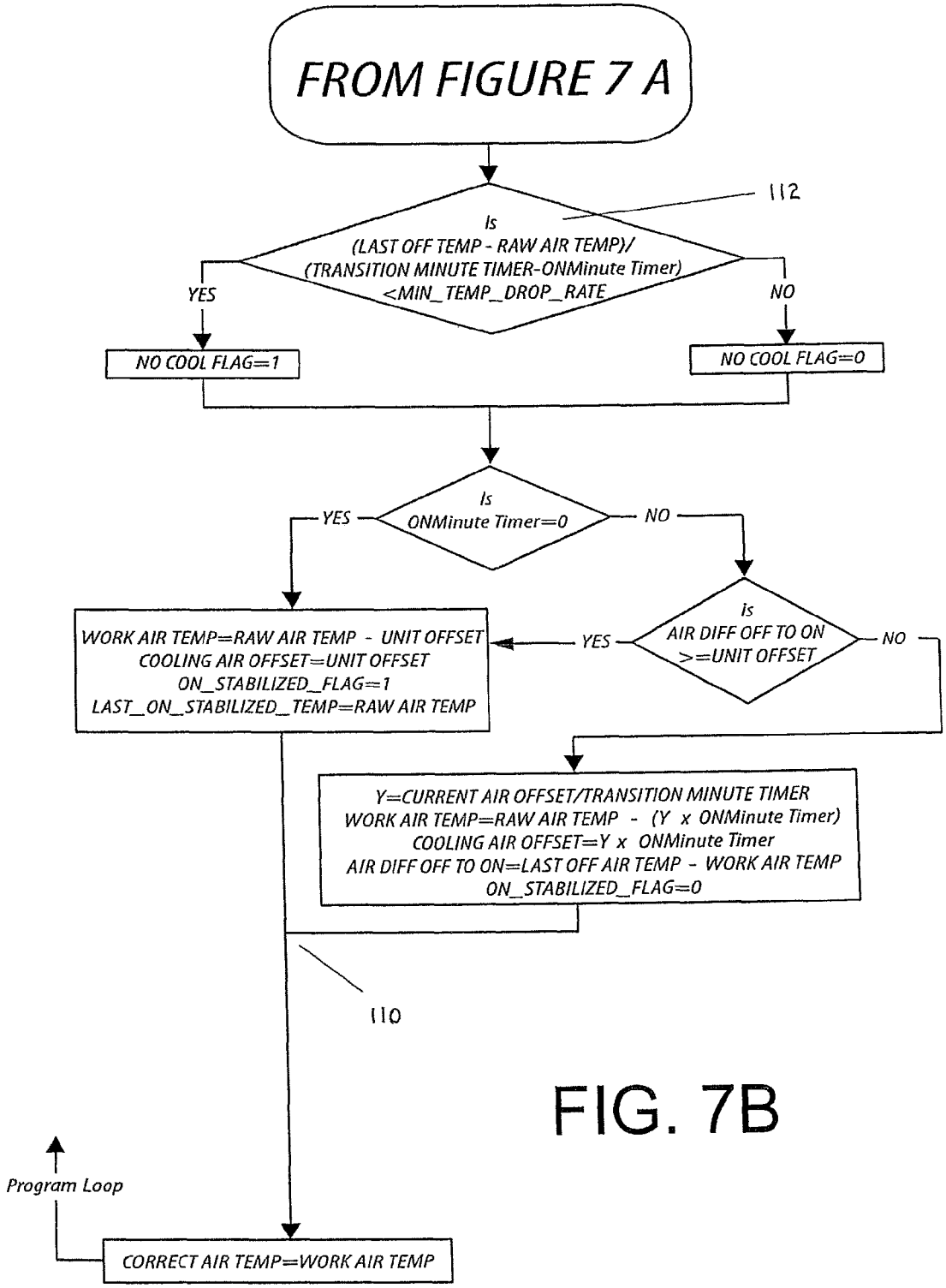
Figure 7C:
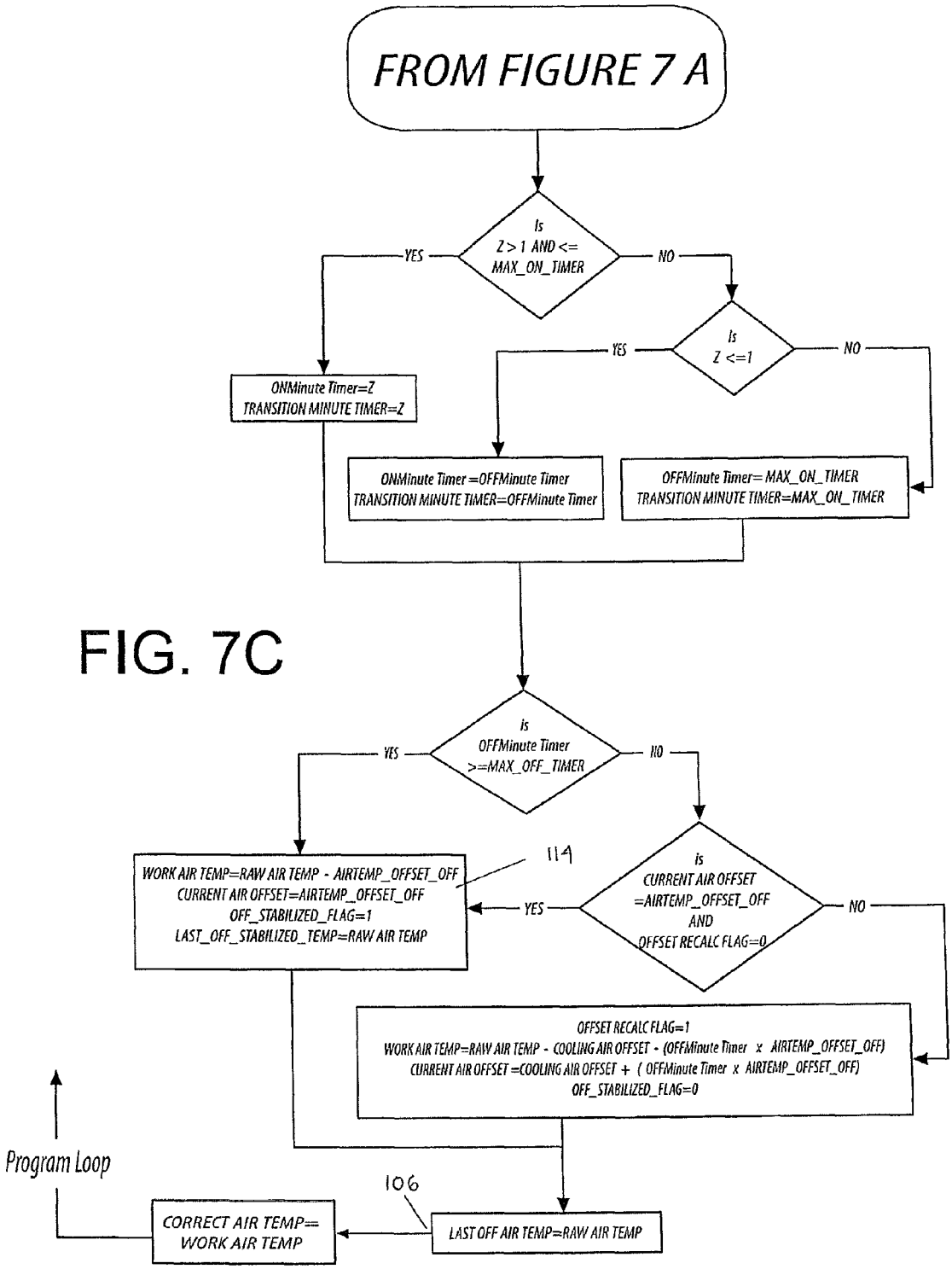
Figure 8:
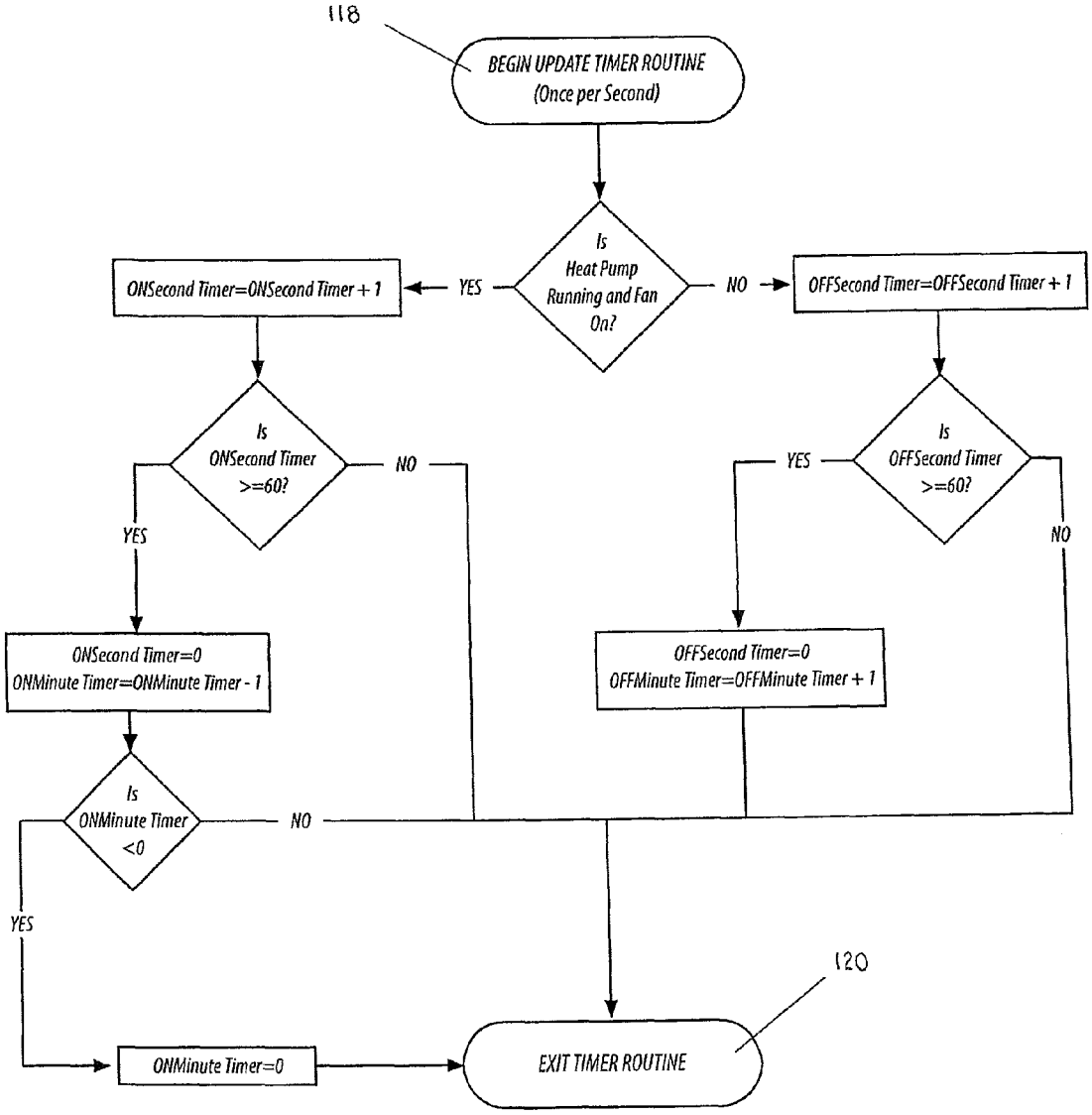
FIG. 8 is a flowchart of another embodiment of a control program for a monitoring and control system for an air source heat pump apparatus according to the principles of the present invention.

One preferred and non-limiting embodiment of the monitoring and control system 10 of the present invention, and particularly the control program, is illustrated in the flow diagram of FIGS. 7A-C. It is noted that the flow diagram of FIGS. 7A-C illustrates only this preferred and non-limiting embodiment of the control program, and does not depict any of the other microprocessor functions of the heat pumps controller 28. The exact lines of code, the order, and the specified arrangement to implement programs A and B may vary as long as they determine the ambient outdoor air temperature using the above-discussed sensor-based methodology.

The circuit board 40 (i.e., controller 28) preferably includes a microprocessor with an analog-to-digital converter on board, as well as memory sufficient to store the control program together with the other logic to appropriately interact with and control the other operable components of the heat pump apparatus 12, such as turning the main heat pump contactor "on" or "off" depending on whether there is a demand for heating (based on the other sensors of the heat pump apparatus 12) and monitoring whether any other appropriate safety or control switches or sensors indicate that the operation of the heat pump apparatus 12 is acceptable or not.

It is also assumed that there are various timer variables that self-increment and store the run time and off time of the heat pump apparatus 12 such as to facilitate the calculations of how much time (e.g., normally minutes) have elapsed at any given point in the control program (by retrieving such variables and performing simple calculations). Therefore, prior to entering the program loops depicted by the flow diagram of FIGS. 7A-C, the microprocessor of the controller 28 has preferably stored flags indicting whether the heat pump apparatus 12 is "on" or "off". Still further, it is noted that all the other microprocessor activities mentioned above (including a continuous looping through the rest of the software program code, such that it is constantly reiterating the program steps through the flow chart at least several times per second) are not specifically depicted in FIG. 7A-C.

With reference to the preferred and non-limiting embodiment of the control program of FIG. 7A, and at step 100, the control program begins as the controller 28 is first powered up and voltage is applied to the heat pump apparatus 12, and to its controls and line to 24 Volt AC transformer, which thereby powers up the controller 28. Upon powering up the controller 28, the next three boxes of the flow diagram of FIG. 7A indicates that the constants and variables are initialized, using the appropriate values determined by testing (as noted above) for the model of heat pump apparatus 12 for which the controller 28 is installed and controlling. As described above, the values shown in FIG. 7A are exemplary and specified based on the results of tests conducted on certain Heat Siphon-brand models; but, they could readily be configured in the control program to work with any size or model of air source heat pump, thus enabling the corrected ambient air temperature to be calculated.

At step 102, the control program begins looping continuously through the flow diagram, and first retrieves a reading from the sensor 30 (in this embodiment, an on-board surface-mounted air thermistor). Using its analog-to-digital converter, the controller 28 then determines the raw air temperature, which is the uncorrected sensor 30 temperature. It then branches to either program A (if the heat pump compressor 18 and fan 14 are not running) or program B (if they are running). At step 104, program A begins and at step 106 (FIG. 7C), it ends. Similarly, at step 108 program B begins, and at step 110 (FIG. 7B), it ends. The flow diagram of FIGS. 7A-C illustrate how the "on" time and "off" time, as well as the above-discussed variables and constants, are used to calculate the ambient (or corrected) air temperature value in each program, which it stores in the "WORK AIR TEMP" variable.

At the end of both programs, the control program then sets the variable "CORRECT AIR TEMP" to "WORK AIR TEMP" and then proceeds through the program loop, where it loops back through all of its other functions (not shown by this flow chart), such as time-keeping and LED display routines, as well as other error checks and switch and sensor monitoring, and the like.

The "Last Off" stabilized air temperature (LAST_OFF_STABILIZED_TEMP) represents the sensor 30 temperature recorded after a sufficient time has passed with the heat pump apparatus 12 and fan 14 "off", such that it has reached "heat transfer" equilibrium and no longer is changing, as the amount of heat gain generated by the circuit board 40 is equal to the heat loss to the unit. Likewise the "Last On" stabilized air temperature (LAST_ON_STABILIZED_TEMP) represents the sensor 30 temperature recorded after a sufficient time has passed with the heat pump apparatus 12 and fan 14 "on" and cooling the second control pocket 36, such that it has reached "heat transfer" equilibrium and no longer is changing, as the amount of heat loss generated by the circuit board 40 is equal to the cooling from the fan 14.

In program B (when the heat pump apparatus 12 is running) at step 112 (FIG. 7B), the control program compares the last RAW THERMISTOR TEMPERATURE with the last stabilized air temperature (LAST_OFF_STABILIZED_TEMP) stored at step 114 (FIG. 7C) just before it turned on. If the difference between these two temperatures, the "Last Off" and "Last on" stabilized temperatures are less than a predetermined value, the control program sets a NO COOL Flag at step 112, which can be used in any other part of the control program to display a warning or error code and/or shut off the heat pump apparatus 12, as it indicates that the heat pump appears to not be cooling off the air, which may indicate a refrigerant leak. Other program actions can be taken elsewhere in the control program loop, including using the ambient air temperature value for any other program decisions, such as shutting off the heat pump apparatus 12 if it is determined to be close to frosting air temperature.

In FIG. 7A, and at step 116, after the external program loop functions are performed, the control program performs an UPDATE TIMER ROUTINE, which implements the necessary timing variable calculations required by programs A and B. This portion of the control program is illustrated in the flow diagram of FIG. 8. At step 118, the control program loop enters this routine once per second using certain timing control variables to determine when to branch into this routine. Depending on whether the heat pump apparatus 12 is running or not, the update timer routine increments or decrements the appropriate algorithm variables, and exits at step 120 back to return control to the main program loop at step 102 (FIG. 7A).

In another preferred and non-limiting embodiment of the monitoring and control system 10 and heat pump apparatus 12 of the present invention, the control program can be configured to determine if heat pump apparatus 12 is producing the proper temperature drop at a given ambient air temperature, thus ensuring that it is working as designed. In addition, this temperature drop calculation can be used to determine whether any operational issues or design problems have occurred. In particular, this determined temperature drop may be used to detect whether there has been a refrigerant leak or one or more of the coils of the evaporator 16 have fowled. In addition, this determined temperature drop may provide an indication of a fan motor failure and/or a binding or failure in any of the bearings.

Still further, and in another preferred and non-limiting embodiment, the monitoring and control system 10 and heat pump apparatus 12 of the present invention may be used to provide additional refinements to the process control of the temperature of a body of water, such as a swimming pool. For example, when the heat pump apparatus 12 is an air source heat pump apparatus for a swimming pool, the control program may be configured, adapted, or programmed to adjust the calculated drop for water temperature, such that the actual stabilization temperature could be checked against the design value to detect water-side issues and problems. For example, the determination of the actual stabilization temperature in comparison to the design value may provide an indication that water flow is diminished, the swimming pool pump filter is clogged, the water temperature is too high for the flow rate, and the like.

In this manner, the monitoring and control system 10 and heat pump apparatus 12 of the present invention provides an improved heat pump arrangement that assists in facilitating the determination of the onset of certain conditions, such as frost conditions, which would affect the operation of the heat pump apparatus 12. In addition, the monitoring and control system 10 and heat pump apparatus 12 of the present invention represent cost effective solutions when considering currently-available methods and approaches for addressing the issue of ambient air temperature impact on the operation of a heat pump. Still further, it is envisioned that the monitoring control system 10 can be used within or integrated with an existing heat pump apparatus through the use of software or firmware in connection with the existing controller for the heat pump apparatus. Overall, the monitoring and control system 10 and heat pump apparatus 12 of the present invention provide improved operations for new and existing heat pump systems.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A monitoring and control system for an air source heat pump apparatus having at least one controller configured to control at least one operation of the heat pump apparatus, at least one temperature sensor configured to detect the temperature in a specified area at or near the controller, and at least one operable component, the system comprising at least one control program stored on a computer readable medium, which, when executed by at least one processor in the at least one controller, causes the processor to:

(a) determine the temperature at, near, and/or around the controller based at least in part on the detected temperature of the at least one temperature sensor;

(b) determine whether a first condition exists, the first condition comprising a determination that the controller is powered, but the heat pump apparatus is not operating;

(c) determine whether a second condition exists, the second condition comprising a determination that the controller is powered, and the heat pump apparatus is operating;

(d) based at least partially on determinations (a)-(c), determine the ambient temperature at or around the heat pump apparatus using a linear function; and (e) control the heat pump apparatus to terminate operating based on the determined ambient temperature, wherein, based upon a determination of the first condition, the control program subtracts a same specified temperature unit over a time increment from the temperature of determination (a) until a stabilization temperature is reached, wherein, thereafter, a constant temperature unit is subtracted from subsequent temperatures of determination (a) to determine the ambient temperature, wherein, based upon a determination of the second condition, the control program adds a same specified temperature unit over time to the temperature of determination (a) until a stabilization temperature is reached, wherein, thereafter, a constant temperature unit is added to subsequent temperatures of determination (a) to determine the ambient temperature, wherein the heat pump apparatus is used to heat a body of water exhibiting a water temperature, and wherein the control program further causes the processor to:

determine a change in the water temperature of the body of water;

determine a temperature drop across the heat pump apparatus based at least in part on the determined ambient air temperature;

adjust the determined temperature drop based on the change in the water temperature;

determine an actual stabilization temperature based on the adjusted temperature drop;

compare the actual stabilization temperature to a design value of the air source heat pump apparatus; and determine, based on the comparison, a water-side issue external to the heat pump apparatus is affecting the operation of the heat pump apparatus.

2. The system of claim 1, wherein the same specified temperature unit is 0.5° F., the constant temperature unit is 8° F., and the time increment is 1 minute.

3. The system of claim 1, wherein the same specified temperature unit is 2° F., the constant temperature unit is 3° F., and the time increment is 1 minute.

4. The system of claim 1, wherein at least one of determinations (a)-(d) occur on at least one of the following bases: incremental, static, specified, continually, dynamically, or any combination thereof.

5. The system of claim 1, further comprising correlating the determined temperature drop to at least one of the following: a refrigerant leak, evaporator coil fouling, fan motor failure, bearing failure, or any combination thereof.

6. The system of claim 1, wherein at least one of determination (a) and determination (d) occurs upon powering of the at least one controller.

7. A heat pump apparatus, comprising:

at least one fan configured to draw ambient air into at least one evaporator arrangement configured to at least partially evaporate at least one liquid refrigerant into gas refrigerant;

at least one compressor configured to draw the gas refrigerant from the evaporator arrangement and compress the gas refrigerant;

a heat exchanger arrangement configured to elevate the temperature of a target liquid or gas;

at least one controller configured to control at least one operation of the heat pump apparatus; at least one temperature sensor configured to detect the temperature in a specified area at or near the controller; and at least one control program stored on a computer readable medium, which, when executed by at least one processor of the at least one controller, causes the processor to:

(a) determine the temperature at, near, and/or around the controller based at least in part on the detected temperature of the at least one temperature sensor;

(b) determine whether a first condition exists, the first condition comprising a determination that the controller is powered, but the heat pump apparatus is not operating;

(c) determine whether a second condition exists, the second condition comprising a determination that the controller is powered, and the heat pump apparatus is operating;

(d) based at least partially on determinations (a)-(c), determine the ambient temperature at or around the heat pump apparatus using a linear function; and (e) control the heat pump apparatus to terminate operating based on the determined ambient temperature, wherein, based upon a determination of the first condition, the control program subtracts a same specified temperature unit over a time increment from the temperature of determination (a) until a stabilization temperature is reached, wherein, thereafter, a constant temperature unit is subtracted from subsequent temperatures of determination (a) to determine the ambient temperature, wherein, based upon a determination of the second condition, the control program adds a same specified temperature unit over time to the temperature of determination (a) until a stabilization temperature is reached, wherein, thereafter, a constant temperature unit is added to subsequent temperatures of determination (a) to determine the ambient temperature, wherein the heat pump apparatus is used to heat a body of water exhibiting a water temperature, and wherein the control program further causes the processor to:

determine a change in the water temperature of the body of water;

determine a temperature drop across the heat pump apparatus based at least in part on the determined ambient air temperature;

adjust the determined temperature drop based on the change in the water temperature;

determine an actual stabilization temperature based on the adjusted temperature drop;

compare the actual stabilization temperature to a design value of the air source heat pump apparatus; and determine, based on the comparison, a water-side issue external to the heat pump apparatus is affecting the operation of the heat pump apparatus.

8. The heat pump apparatus of claim 7, further comprising a housing configured to at least partially surround at least a portion of the operable components of the heat pump apparatus.

9. The heat pump apparatus of claim 8, further comprising a pocket on the housing configured to at least partially surround the at least one controller.

10. The heat pump apparatus of claim 9, wherein the pocket is in a substantially triangular shape.

11. The heat pump apparatus of claim 7, wherein the at least one temperature sensor is positioned on the controller on a specified periphery thereof.

12. In a heat pump apparatus having: at least one fan configured to draw ambient air into at least one evaporator arrangement configured to at least partially evaporate at least one liquid refrigerant into gas refrigerant; at least one compressor configured to draw the gas refrigerant from the evaporator arrangement and compress the gas refrigerant; a heat exchanger arrangement configured to elevate the temperature of a target liquid or gas; at least one controller configured to control at least one operation of the heat pump apparatus; and at least one temperature sensor configured to detect the temperature in a specified area at, near, and/or around the controller, a monitoring and control system comprising at least one control program stored on a non-transitory computer readable medium, which, when executed by at least one processor of the at least one controller, causes the processor to:

(a) determine the temperature at or near the controller based at least in part on the detected temperature of the at least one temperature sensor;

(b) determine whether a first condition exists, the first condition comprising a determination that the controller is powered, but the heat pump apparatus is not operating;

(c) determine whether a second condition exists, the second condition comprising a determination that the controller is powered, and the heat pump apparatus is operating;

(d) based at least partially on determinations (a)-(c), determine the ambient temperature at or around the heat pump apparatus using a linear function; and (e) control the heat pump apparatus to terminate operating based on the determined ambient temperature, wherein, based upon a determination of the first condition, the control program subtracts a same specified temperature unit over a time increment from the temperature of determination (a) until a stabilization temperature is reached, wherein, thereafter, a constant temperature unit is subtracted from subsequent temperatures of determination (a) to determine the ambient temperature, wherein, based upon a determination of the second condition, the control program adds a same specified temperature unit over time to the temperature of determination (a) until a stabilization temperature is reached, wherein, thereafter, a constant temperature unit is added to subsequent temperatures of determination (a) to determine the ambient temperature, wherein the heat pump apparatus is used to heat a body of water exhibiting a water temperature, and wherein the control program further causes the processor to:

determine a change in the water temperature of the body of water;

determine a temperature drop across the heat pump apparatus based at least in part on the determined ambient air temperature;

adjust the determined temperature drop based on the change in the water temperature;

determine an actual stabilization temperature based on the adjusted temperature drop;

compare the actual stabilization temperature to a design value of the air source heat pump apparatus; and determine, based on the comparison, a water-side issue external to the heat pump apparatus is affecting the operation of the heat pump apparatus.

* * * * *